US010688360B2

(12) United States Patent
Allen et al.

(10) Patent No.: US 10,688,360 B2
(45) Date of Patent: Jun. 23, 2020

(54) METHOD AND APPARATUS FOR PROPELLING GOLF BALLS AND OTHER OBJECTS

(71) Applicant: Frank Gontarski, Orangevale, CA (US)

(72) Inventors: Dana R. Allen, Reno, NV (US); Frank Gontarski, Orangevale, CA (US); Aaron J. Klemenok, Magalia, CA (US); Kenneth C. MacNeill, Jr., Fair Oaks, CA (US)

( * ) Notice: Subject to any disclaimer, the term of this patent is extended or adjusted under 35 U.S.C. 154(b) by 0 days.

(21) Appl. No.: 14/282,688

(22) Filed: May 20, 2014

(65) Prior Publication Data

US 2014/0345585 A1 Nov. 27, 2014

Related U.S. Application Data

(60) Provisional application No. 61/825,632, filed on May 21, 2013.

(51) Int. Cl.

| | |
|---|---|
| ***A63B 102/32*** | (2015.01) |
| ***A63B 65/12*** | (2006.01) |
| ***A63B 71/00*** | (2006.01) |

(52) U.S. Cl.

CPC .... *A63B 65/122* (2013.01); *A63B 2071/0081* (2013.01); *A63B 2102/32* (2015.10); *A63B 2220/13* (2013.01); *A63B 2220/20* (2013.01)

(58) Field of Classification Search

CPC ..... F41B 7/00; F41A 19/00; A63B 65/122
USPC ..... 124/31, 79, 80
See application file for complete search history.

(56) References Cited

U.S. PATENT DOCUMENTS

| | | | | | |
|---|---|---|---|---|---|
| 1,543,144 | A | | 6/1925 | Wurm | |
| 1,866,926 | A | | 7/1932 | Colby | |
| 2,523,805 | A | * | 9/1950 | Anthony | A63B 69/407 124/16 |
| 2,815,212 | A | * | 12/1957 | Hall | A63F 7/2472 124/27 |
| 3,850,157 | A | | 11/1974 | Prokupek | |
| 3,897,061 | A | * | 7/1975 | Grattan | F41B 7/00 124/26 |
| 4,335,701 | A | * | 6/1982 | Bozich | A63B 69/407 124/26 |
| 5,224,701 | A | * | 7/1993 | Sciarrillo | A63B 69/409 124/56 |

(Continued)

FOREIGN PATENT DOCUMENTS

| | | | |
|---|---|---|---|
| CN | 202993971 | U | 6/2013 |
| EP | 0041206 | A1 | 12/1981 |
| WO | 2004106836 | A1 | 12/2004 |

*Primary Examiner* — Jeffrey S Vanderveen

(57) ABSTRACT

A portable apparatus propels a projectile such as a golf ball, without the use of any external source of power. A striking driver is retracted, to a non-equilibrium position, by application of force, and is held in the non-equilibrium position. When the striking driver is released, it travels along a guided path and forcibly contacts the projectile, which is held in a loading port. Differential friction devices may be used on the projectile and/or the striking driver, to impart spin to the projectile. A rotary trigger alternately blocks and unblocks the striking driver, enabling control of the release of the striking driver. The apparatus may include various safety devices which prevent accidental release of the striking driver.

17 Claims, 7 Drawing Sheets

(56) References Cited

U.S. PATENT DOCUMENTS

| | | | | | |
|---|---|---|---|---|---|
| 5,447,144 | A * | 9/1995 | Ivy | A63B 69/407 | 124/21 |
| 5,613,678 | A | 3/1997 | McKee et al. | | |
| 5,711,284 | A * | 1/1998 | Keenan, Jr. | F41B 5/14 | 124/49 |
| 6,159,112 | A * | 12/2000 | Ciluffo | A63B 69/0024 | 124/4 |
| 6,805,111 | B2 * | 10/2004 | Tippmann, Jr. | F41A 21/00 | 124/74 |
| 6,807,959 | B1 | 10/2004 | Murdock | | |
| 7,063,623 | B2 | 6/2006 | Wengert | | |
| 7,603,998 | B2 * | 10/2009 | Finstad | F41B 11/00 | 124/73 |
| 7,849,725 | B1 | 12/2010 | Nelson | | |
| 8,485,174 | B2 | 7/2013 | Bissonnette et al. | | |
| 8,567,377 | B2 * | 10/2013 | Victor | F41B 7/003 | 124/27 |
| 2002/0134366 | A1 * | 9/2002 | Rehkemper | F41B 4/00 | 124/78 |
| 2003/0069091 | A1 * | 4/2003 | Wengert | A63B 69/36 | 473/409 |
| 2003/0071077 | A1 * | 4/2003 | Panzarella | F41B 9/00 | 222/386 |
| 2007/0044782 | A1 * | 3/2007 | Norkus | F41B 5/0094 | 124/25.6 |
| 2011/0214653 | A1 * | 9/2011 | Lyon | F41B 5/14 | 124/23.1 |
| 2013/0074818 | A1 * | 3/2013 | Victor | F41B 7/08 | 124/16 |
| 2014/0102431 | A1 | 4/2014 | Kennedy | | |
| 2014/0261360 | A1 * | 9/2014 | Pulkrabek | F41B 5/1469 | 124/35.2 |

* cited by examiner 37
38
35
26
26
36
16
FIG 2.1
36
39
16
FIG 2.2
58
39
16
FIG 2.4
FIG 2.3
36
16
112
112
38
26
37
110
111
36
16
FIG 2.5
55
17
40
25
26
37
16
28
12
11
58
110
42
22
111
23
45
21
24
19

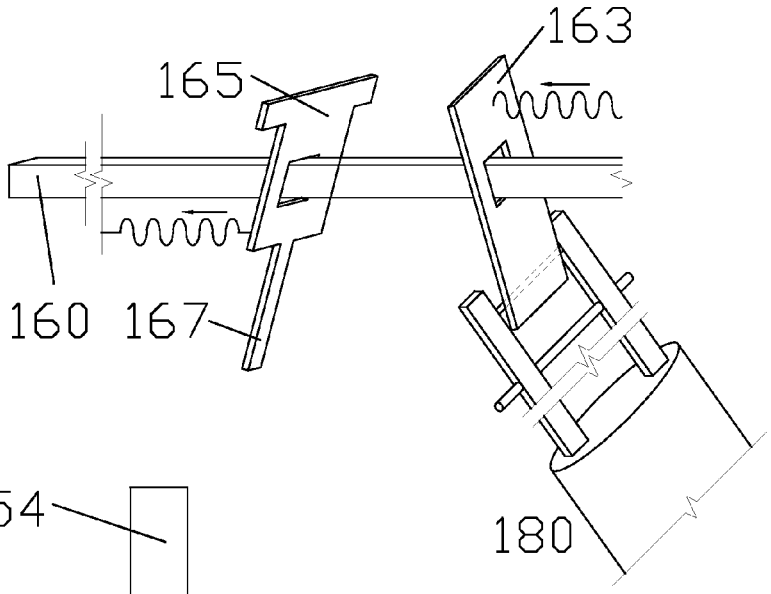
FIG 11
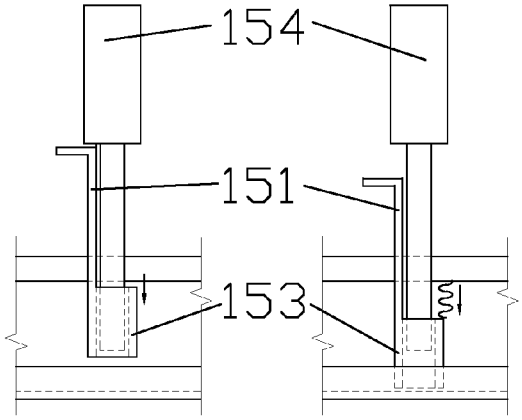
FIG 12A FIG 12B
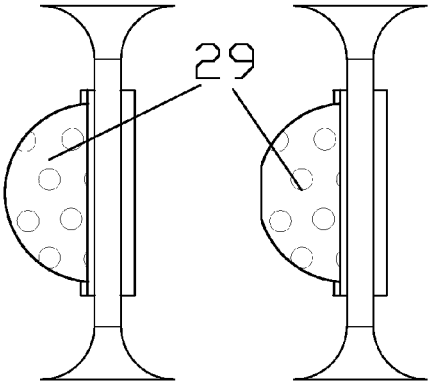
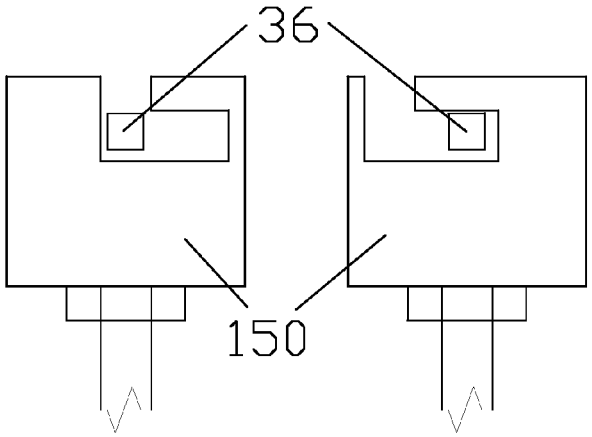
FIG 13A FIG 13B FIG 14A FIG 14B

METHOD AND APPARATUS FOR PROPELLING GOLF BALLS AND OTHER OBJECTS

CROSS-REFERENCE TO PRIOR APPLICATION

Priority is claimed from U.S. Provisional Patent Application Ser. No. 61/825,632, filed May 21, 2013, the disclosure of which is hereby incorporated by reference.

FIELD OF THE INVENTION

The present disclosure relates generally to the field of launching objects for sports or other activities without the use of explosives or pre-compressed gases. It relates, in particular, to the field of launching golf balls with an apparatus that uses springs similar to how crossbows fire crossbow bolts, as an alternative to using golf clubs.

DESCRIPTION OF THE RELATED ART

Currently golf balls are primarily launched via a person swinging a golf club and hitting the ball. This is a very high skill operation, prone to failure by the average golfer. In addition to the high skill level required for all golfers, as golfers age past 50 or 60 years, they tend to be able to continue to play at the same level for short shots, but lack the strength and flexibility to make as long of shots as they were able to when younger. These factors reduce the number of persons who play golf.

There have been prior attempts to launch golf balls with pre-compressed gases or explosives/propellants as in using a rifle with blank charges. U.S. Pat. No. 7,063,623 is one example of using a rifle like device. U.S. Pat. No. 789,725 describes an air cannon to launch golf balls.

Neither has been accepted to any significant degree by golfers. In the case of pre-compressed gases, the problems of carrying large amounts of compressed gases that may run out during the game and the cost of the apparatus discourages use. In the case of persons with rifles loudly firing golf balls on golf courses, other golfers do not find this acceptable.

SUMMARY OF THE INVENTION

The present disclosure provides an apparatus, system, and method with several embodiments that overcome the limitations of the prior art. The present disclosure accomplishes this by providing a system of launching a golf ball or other objects with a spring that can be manually (or by machine) constantly recharged for additional golf shots. The preferred embodiment is to use a springlike apparatus similar to a crossbow that launches the golf ball via propelling a device similar to a golf driver head, another golf ball, or other striking mass via the cable/string which travels down a guiding mechanism until it hits the golf ball. The golf ball reacts similarly to how it would react to a golf club strike, i.e. the golf ball is propelled forward. This golf ball launching apparatus will be referred to in this document as a golf bow.

The present invention therefore comprises a) means for displacing the striking driver from an equilibrium position to a non-equilibrium position, and for applying a force so as to hold the striking driver in its non-equilibrium position, b) means for releasing the striking driver such that the striking driver is free to move towards its equilibrium position and beyond, and c) means for guiding the striking driver such that the striking driver, after being released, forcibly contacts a projectile held in a loading port.

After the launching of the golf ball, to take another shot the golfer simply needs to insert the golf ball and recycle the cable/string again for the next shot. The cable/string can be retracted partially or completely. This allows the golfer to mimic traditional golf club selection for distance. Existing golf courses, golf balls, putters and sand wedges can be used, so there is an easy transition from club golf to the present invention.

In addition, the golfer can aim the apparatus at different angles in combination with drawing the cable/string variable amounts. This gives the golfer a great deal of control over the distance and flight path of the ball. The golfer can also control top spin and backspin, left spin (hook) and right spin (slice) via differential friction on the struck golf ball with either a non-rotating striking driver or a rotating striking driver, which may be a golf ball itself, with a hole through it that the cable/string passes through. In addition, top spin and back spin can be generated with a rotating striking driver by applying differential friction to the top or bottom of the rotating striking driver which is then transferred to the struck golf ball in the opposite direction giving the struck golf ball top spin or back spin. Both of these methods of generating spin can potentially be used at the same time, if so desired.

In summation, with the present disclosure golfers can have better control of distance, angle and spin on the golf ball than traditional club golf allows, and use of the present invention requires significantly less skill and physical strength to obtain that greater golf ball control.

These and other objects and advantages of the present disclosure will become apparent to those of ordinary skill in the art after having read the following detailed description of the preferred embodiments, which are also illustrated in the various drawing figures. The current disclosure is not limited to golf ball launching, but can also be used with tennis balls, baseballs, and other objects. The current disclosure will use the golf ball launching paradigm to explain the invention.

BRIEF DESCRIPTION OF THE DRAWINGS

The drawings included herewith are incorporated in and form a part of this specification. The drawings illustrate one embodiment of the present disclosure and, together with the description, serve to explain the principles of the invention. It should be understood that drawings referred to in this description are not drawn to scale unless specifically noted.

FIG. 2.1 provides detail drawings showing the striking driver and related components.

FIG. 2.2 is a side view close-up of the rotating striking driver and the driver release mechanism (16) being pushed to the left so as to open the spring loaded jaws over the carriage tube (36).

FIG. 2.3 shows in side view after the spring loaded jaws of (16) have been moved far enough leftward so they closed over (36) so the golf bow striking head (26) can be retracted to the right.

FIG. 2.4 provides a detail drawing of a sheathed cable system which forms part of a trigger mechanism in one embodiment of the invention.

FIG. 2.5 shows the same the same thing as FIG. 2.3 does, but in front view.

FIG. 11 provides a detail drawing, in perspective, of the embodiment of FIG. 10, showing binder clamps used on a retraction friction tube.

FIGS. 12A and 12B provide two detail drawings, showing locked and unlocked conditions of a safety device which prevents the device from being accidentally fired.

FIGS. 13A and 13B provides a side views of an alternative embodiment in which the striking driver has a generally hemispherical configuration, FIG. 13B showing the case where the striking driver includes a flattened portion.

FIGS. 14A and 14B provides a pair of drawings illustrating the operation of the rotary trigger, the drawings showing the condition where the striking driver is prevented from firing, and the condition in which the striking driver is released.

DETAILED DESCRIPTION OF THE INVENTION

Reference will now be made in detail to the preferred embodiments of the invention. Examples of the preferred embodiment are illustrated in the accompanying drawings. While the invention will be described in conjunction with the preferred embodiments, it is understood that they are not intended to limit the invention to these embodiments. Rather, the invention is intended to cover alternatives, modifications and equivalents, which may be included within the spirit and scope of the invention. Additionally, in the following detailed description of the present disclosure, numerous specific details are set forth in order to provide a thorough understanding of the present disclosure. However, it will be apparent to one of ordinary skill in the art that the present disclosure may be practiced without these specific details. In other instances, well-known methods, procedures, components, and circuits have not been described in detail so as not to unnecessarily obscure aspects of the present disclosure.

A. Functional Operation

Figure 1:
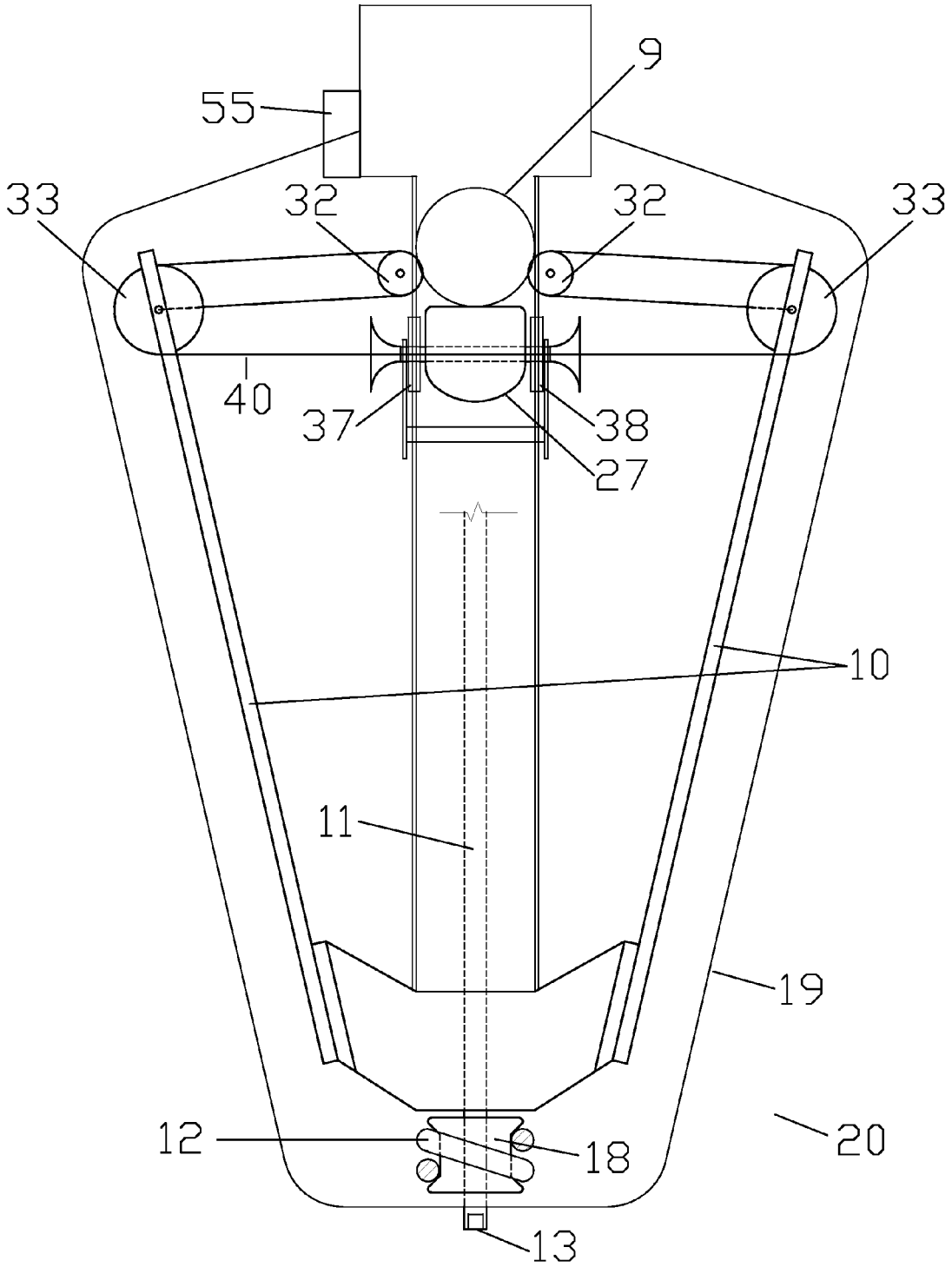
FIG. 1 is an overhead view of the golf bow apparatus that has not been drawn back or retracted, and which does not have the struck golf ball inserted yet. It has a non-rotating striking driver. The bow limbs can be configured many ways just as they are in crossbows, and this is just one configuration that is the preferred embodiment as it is very compact in form factor.
Figure 2:
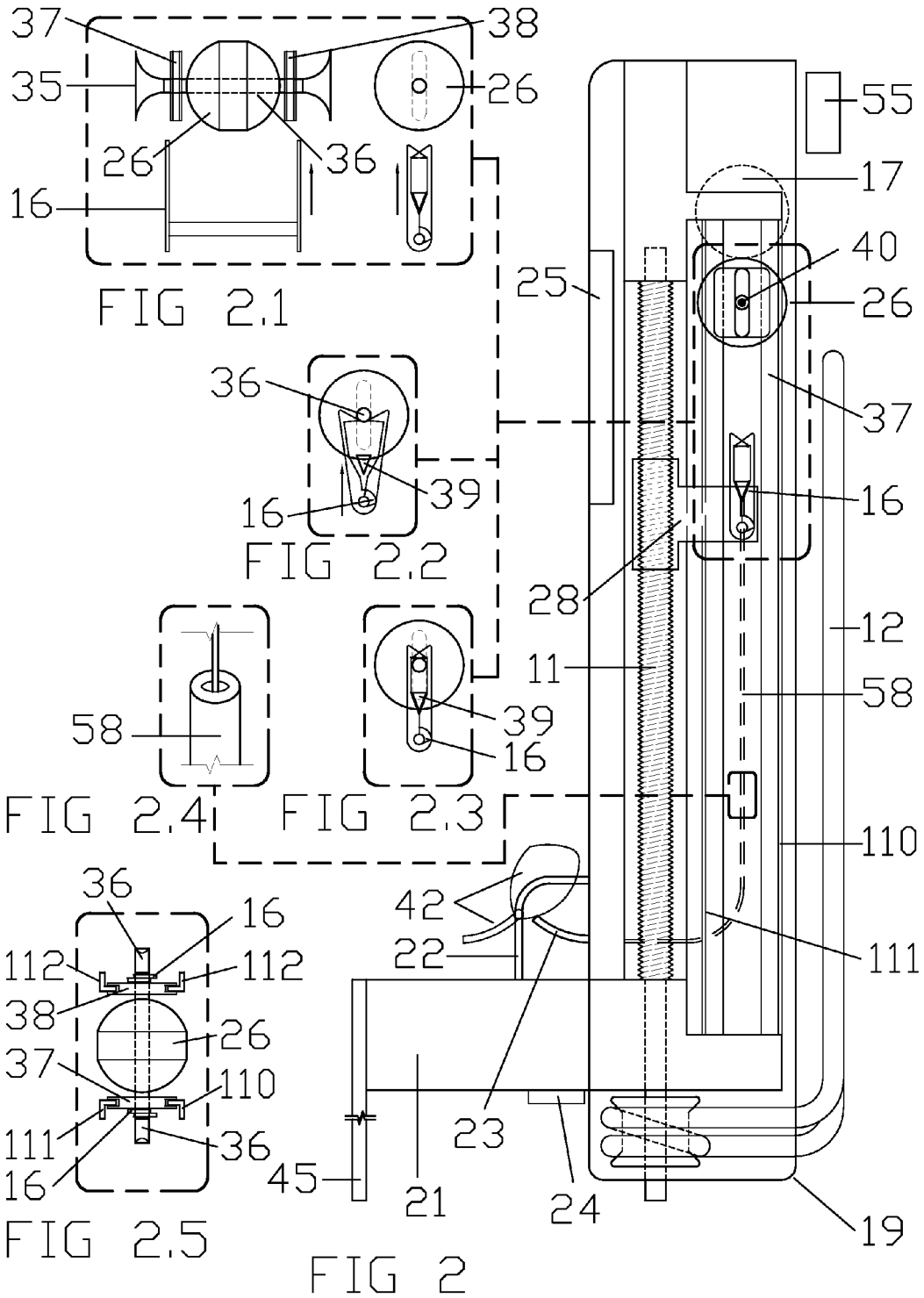
FIG. 2 shows the golf bow apparatus from side view after it was fired with about ⅓ power and after a new golf ball has been inserted.

Referring now to FIG. 1, the limbs (10) of the golf bow (20) (the entire apparatus shown in FIG. 1) are bent via a jack-screw (11) being rotated in one direction thus making the jack screw follower apparatus FIG. 2 (28) move to the right, which retracts the golf bow cable/string (40) which generates a bending of the limbs (10) storing energy. Comparing FIG. 1 where the striking driver (27) is not retracted and the bow limbs (10) are not bent much and are not storing much energy, to FIG. 3 where the striking driver, in this case (26), is fully retracted and the bow limbs (10) are bent a great deal and thus are storing a great deal of energy, shows the principle of stored energy for the current disclosure. FIG. 1 shows pulleys with both a fixed inner pulley (32) and moving outer pulley (33) that in the preferred embodiment increase the cable/string travel with the same amount of limb bending compared to not using pulleys, which assists in reducing the pull weight to retract the cable/string. The cable/string (40) is terminated at the center of the moving outer pulley (33) and then routes around fixed inner pulley (32) then around the moving outer pulley (33) and then through striking driver (27). The invention can also use the same basic arrangement without pulleys. The left and right limbs (10) and pulleys (32) and (33) operate the same way on both sides.

The limbs are relaxed if the rotation of the jack-screw is in the opposite direction. The preferred embodiment is to rotate the FIG. 1 and FIG. 2 jack-screw (11) with a FIG. 1 cord pulley (18) attached to the jack-screw rotated by at rubber cord (12), rope or similar device. To assist this pulling on the rubber cord (12) a foot anchor (45) in FIG. 2 holds the golf bow down while the cord is pulled up. This gives the golfer an easy method to rapidly rotate the jack-screw to cock the golf bow and to reverse direction if less power is desired by pulling on the other side of the cord loop. The jack-screw (11) retains its position if the rubber cord (12) breaks or the golfer lets go of it. This is a safety feature of jack-screws. The jack-screw can also have a socket (13) so a portable hand drill or similar device can be used to spin the jack-screw and in so doing cock or retract the golf bow. A hand tool such as a ratchet can also be used to rotate the jack-screw. The power to launch the golf ball or other objects comes from the energy built up in the bow limbs transferred to the striking driver (27) being released by the driver release mechanism (16) and it accelerates to strike the struck golf ball (17) and launch it. The pathway for the driver is guided by the driver guides (37) and (38) which are shown in side view in FIG. 2.1 and in front view FIG. 2.5 being guided by the guide rails (110), (111), (112), and (113). There is a safety shroud FIG. 1 (19) that covers the top and bottom of the cable/string (40) and the limbs (10) pathway during firing to prevent injury.

Referring now to FIG. 2, the golf bow is shown in a side view. The jack-screw (11) is easier to view in this view as it is below the guided pathway of the striking driver. The hand grip (21), trigger guard (22) and trigger are exposed in this view. Safety devices which can be part of the current disclosure are illustrated as grip safety (24) that requires that it be depressed for the trigger to work and the forearm safety (25) which can be on both sides of the forearm. The reason for (24) and (25) is to prevent accidental firing by requiring both hands to be properly placed to aim the golf bow depressing these safeties before the trigger can be depressed and fire the golf bow. The safety devices include a trigger safety not illustrated that is manually operated to prevent the trigger from being pulled as is common with firearms. Another safety device not illustrated can be implemented that locks the release mechanism (16) in FIG. 2.2 and FIG. 2.3 from being opened to release the striking driver of (26) or (27) type.

Another safety device is a spring held trigger shield (42) over the trigger guard (22) in FIG. 2 that has to be held down with fingers below the index finger before the index finger can be inserted in the trigger guard (22) to pull the trigger (23). This makes accidental pulling of the trigger highly unlikely from being pulled while walking through brush as a spring loaded shield first has to be pulled out of the way and held there and the trigger (23) then has to be also pulled. This also requires normally for the trigger hand to properly be in position.

Another safety device is the object sensor safety (55) in FIG. 1 that detects if an object is inline with the firing path of the golf bow at a certain distance that would indicate danger. Normally the bow is pointed upward into the air so no object should provide a return signal to the various detectors in the current state of the art such as infrared, optical, sonic, and radar sensors. The distance is easily detectable in the state of the art so the user will be warned with this optional safety feature and the trigger locked if an object is detected in the line of fire at a distance considered dangerous The user after the warning can override the warning. The current disclosure also will have an option to use the same object distance sensor to gauge the distance to a putting green or other feature on the golf course so as to aid the golfer in selecting the right power to use for a golf bow shot.

The safety shroud (19) surrounds the entire path of the cable/string (40) from above and below so that users can not accidentally place their fingers into the pathway of the cable/string when the golf bow is fired. The preferred embodiment of the protective shroud is a transparent or translucent shroud so the user can watch the operation of the golf bow, inspect it safely visually to judge where the various internal parts are and their condition, and to keep dirt and other objects from getting into the various parts of the golf bow apparatus.

The ball loading port (9) to insert the golf ball (17) into on FIG. 1 has a safety device to prevent it from being opened unless the striking driver (26) or (27) is in its neutral (not retracted) position thus does not have the potential to be fired.

FIG. 2 shows a rotating striking driver (26) which can be a golf ball drilled through and in this case beveled flat at the outer impact point as shown in FIG. 2.1. For the current disclosure it is optional whether the striking driver is non-rotating as in FIG. 1 (27) or a rotating striking driver as in FIG. 2 and FIG. 2.1 (26). The bevel in FIG. 2.1 is a preferred embodiment that helps generate a more accurate struck golf ball (17) flight by flattening the impact point of the striking driver horizontally. The lower part of FIG. 2.1 is an overhead view of the rotating striking driver on the left and the driver release mechanism on the right. The upper part of FIG. 2.1 is a side view of the same two mechanisms. In FIG. 2.1 the rotating striking head carriage (35) passes through rotating striking driver (26) with carriage tube (36) being a hollow tube that the rotating striking driver (26) can rotate either direction on. The golf bow cable/string (40) on FIG. 1 runs through the carriage tube (36) as shown in FIG. 2 which in the preferred embodiment is flared at the ends as shown in FIG. 2.1 so as to increase the bend radius for (40) to reduce stress and wear on (40) when the golf bow is retracted as the retraction force can exceed 100 pounds. The golf bow cable/string (40) can be made of a non-metallic bow string, a wear resistant material such as stainless steel cable, or any other material with proper strength, flexibility and wear properties.

Figure 3:
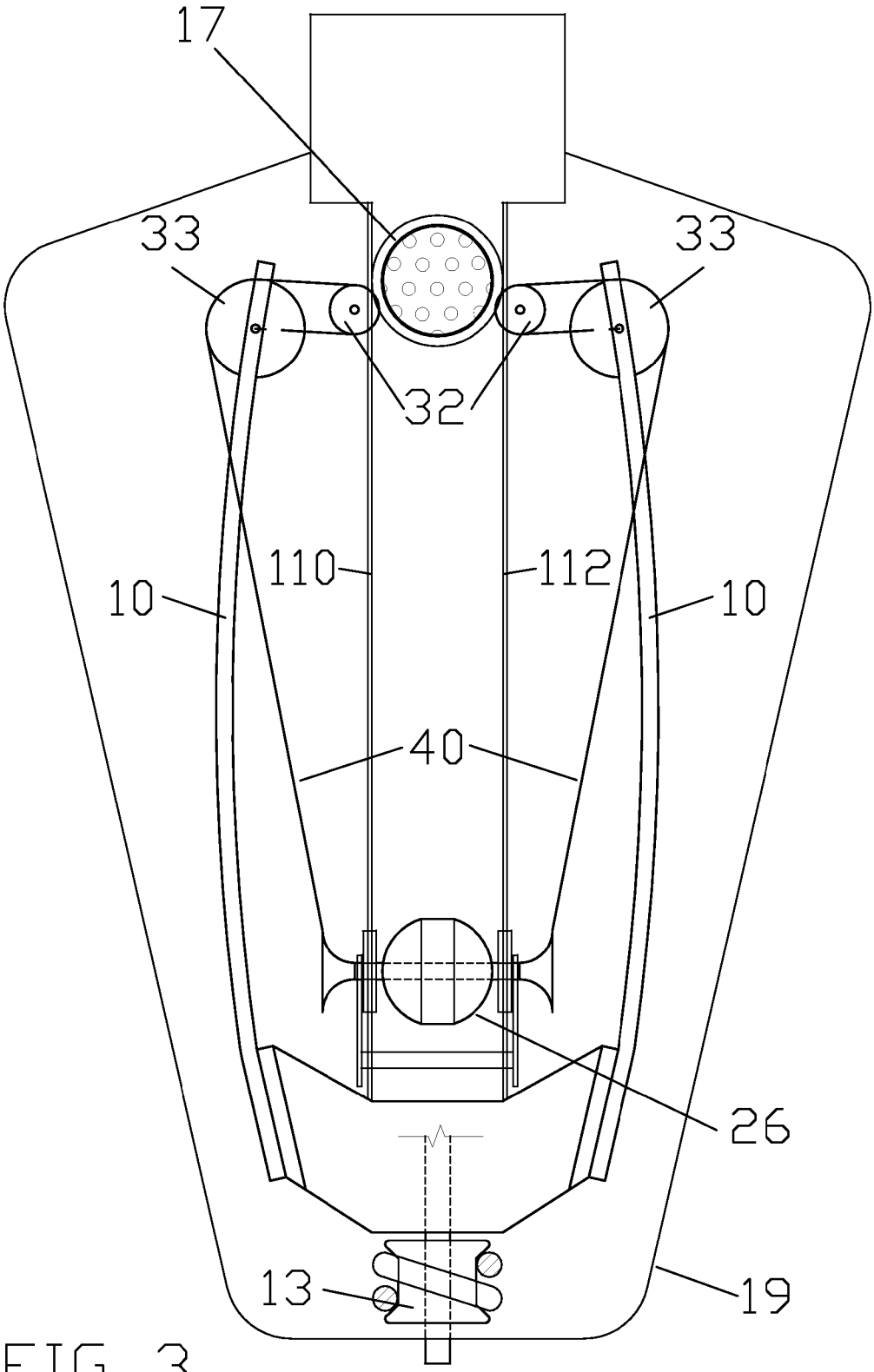
FIG. 3 is an overhead view of the golf bow apparatus that is drawn fully and it does have the struck golf ball (17) inserted. This is ready to fire and is a rotating striking driver version.

FIG. 3 shows the golf bow fully retracted for maximum golf ball driving speed. The present disclosure allows the user to precisely regulate the speed at which the golf ball is fired by how far back the jack-screw pulls back the cable/string (40) via the jack screw follower apparatus (28). FIG. 2 shows the jack screw follower apparatus (28) positioned about ⅓ to the fully retracted position but the cable/string (40) is not retracted at all. This is where both parts would be after the golf bow was retracted to ⅓ of the maximum and then has been fired. To make the next shot, the jack-screw is rotated so that the jack-screw follower apparatus (28) moves to the left (less retracted or drawn position) and, as FIG. 2.2 shows, it will cause the driver release mechanism (16) jaws to contact the carriage tube (36). The spring assisted normally closed jaws of (16) open up due to the inclined plane aspect of the forward contact points as shown in FIG. 2.2 and then grab around the hollow tube (36) as shown in FIG. 2.3 and FIG. 2.5. After the driver release mechanism (16) has closed on the carriage tube 36, the golf bow striking head (26) or (27) can now be retracted. It is retracted by reversing the direction of the jack-screw rotation and the jack screw follower apparatus (28) then pulls the cable/string (40) to the right to gradually increase the power to fire the struck golf ball (17).

If the cable/string is partially retracted or fully retracted as shown in FIG. 3, it can then be fired by pulling the trigger (23) in FIG. 2 which pulls the actuated sheathed cable system (58) as shown in FIG. 2.4, similar to how a bicycle cable brake works, which then opens the jaws of the driver release mechanism (16) via a mechanism such as release mechanism wedge (39) in FIG. 2.3 being pulled to the right which opens the jaws of (16) to release the rotating striking driver (26) in FIG. 3 which then, with significant speed, moves towards and strikes the struck golf ball (17) propelling it out of the golf bow apparatus with similar speed as a full power golf driver club swing does. Unlike conventional club golf, the user can easily regulate the upward angle and direction of the golf ball by simply aiming the golf bow. This is just one embodiment for a driver release mechanism; many other methods of transferring the energy of the trigger to the driver release mechanism (16) such as hydraulics and mechanisms other than a wedge (39) to open the release jaws of (16) can be used, as will be apparent to those familiar with the state of the art.

The present disclosure, so far, has shown just a few of the many possible implementations of this invention with the current state of the art. Conventional club golfers with higher skill levels impart "hook" and "slice" and top-spin and back-spin to the golf ball via striking the ball in special ways to get the golf ball path to curve in the direction they want whether left, right, up or down. The same effect can be generated by the present disclosure in multiple ways.

Figure 4:
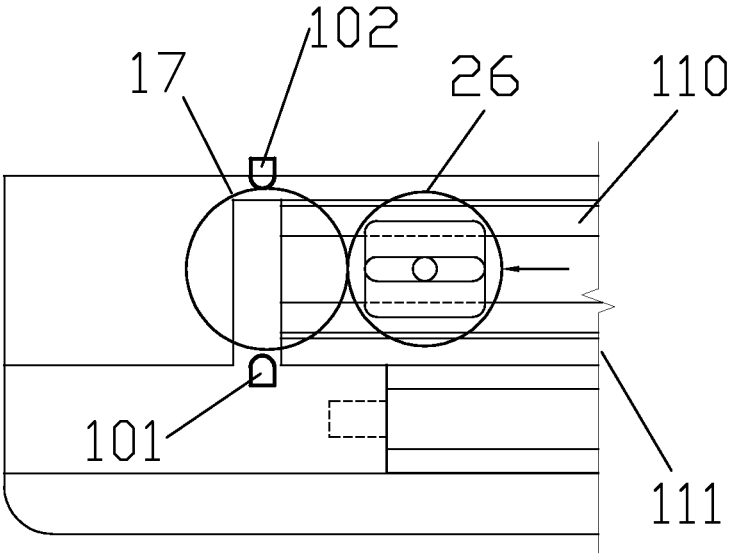
FIG. 4 is a side view of the golf bow with a rotating striking driver (26) at the time of impact after the trigger has been pulled and the cable/string has propelled the striking driver forward into contact with the struck golf ball. It also illustrates the differential friction devices for the struck golf ball with the backspin friction device (102) engaged.
Figure 5:
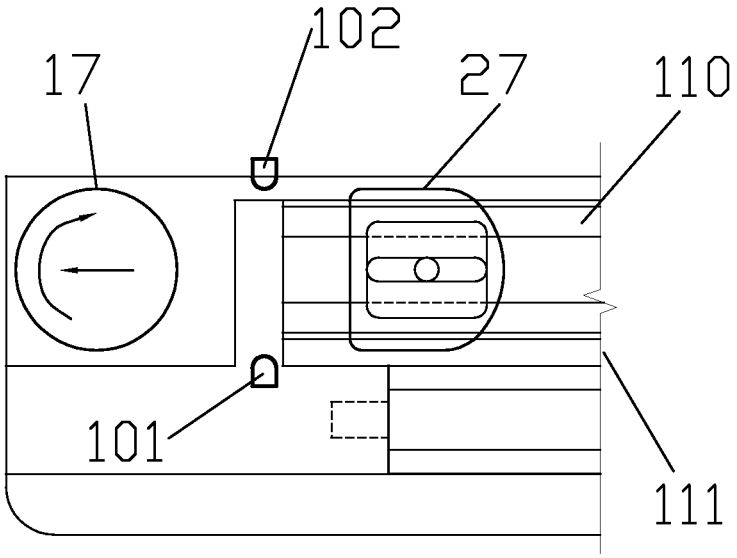
FIG. 5 is a side view of the golf bow with non-rotating striking driver (27) after impact showing that the differential friction applied by the backspin friction device (102) has imparted backspin on the struck golf ball (17).

For backspin and topspin as shown in FIG. 4 and FIG. 5 in side view, differential friction can be applied to the struck golf ball (17) via moving into contact with the struck golf ball a friction apparatus made of material like rubber on just the top or just the bottom of the struck golf ball (17), as illustrated by topspin friction device (101) and backspin friction device (102) in FIG. 4. FIG. 4 shows backspin friction device (102) being in contact with the struck golf ball (17) while the topspin friction device (101) is not. When the trigger releases the rotating striking driver (26) and it strikes (17) in this situation the struck golf ball (17) will be slowed down on the top by backspin friction device (102) and thus (17) develops backspin as shown in FIG. 5. If topspin friction device (101) were moved upward into contact with the struck golf ball (17) and 102 was moved upward out of contact with the struck golf ball (17) then when it was struck, topspin would develop as the rotation would be the opposite as to what is shown in FIG. 5.

The same effect of applying topspin and backspin can be accomplished by having topspin friction device (101) and backspin friction device (102) in contact with the struck golf ball but with a high friction material on one of them and a low friction material on the other. This can be accomplished in many ways including (101) and (102) being rotatable wheels or replaceable friction elements with friction materials of varying friction. This is the preferred implementation of applying differential friction on the struck golf ball to create backspin, topspin, hook (left curve) and slice (right curve). With the non-rotating striking driver implementation differential friction to the struck golf ball is the preferred implementation for backspin and top spin. For both non-rotating (27) and rotating striking drivers (26) hook and slice can be generated with differential friction applied to the struck golf ball (17) on the left or right side of the struck golf ball (17) respectively in a similar manner as to (101) and (102) apply top spin and back spin. The left spin and right spin friction devices for hook and slice are not illustrated, but work in the same manner as (101) and (102) and are on the left and right side of the struck golf ball (17).

Figure 6:
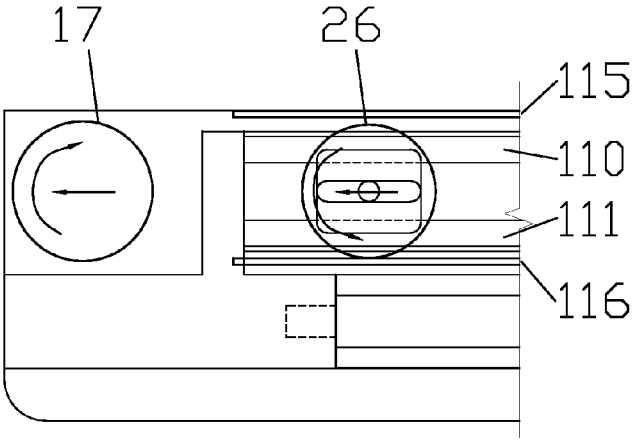
FIG. 6 shows the rotating striking head (26) whereby that rotating striking head was given top spin by friction from bottom friction device (116) and that translated into backspin for the struck golf ball (17).
Figure 7:
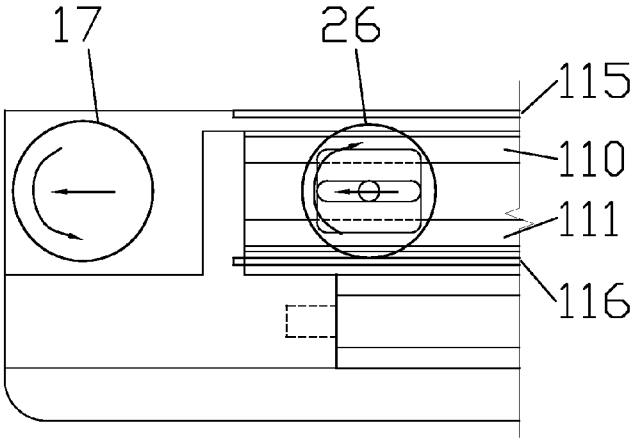
FIG. 7 shows the rotating striking head (26) whereby that rotating striking head was given back spin by friction from the bottom friction device (116) and that translated into topspin for the struck golf ball (17).

There is another way to generate backspin and topspin on the rotating striking driver version. That is to apply friction to the rotating striking driver after it is released and heading towards the impact with the struck golf ball. In the pathway of the striking driver before impact, the top or bottom of the rotating head can have a friction device (115) incrementally positioned so as to generate a variable backspin as shown in FIG. 6 on the rotating striking head (26) or variable topspin as shown by bottom friction device (116) in FIG. 7 on the rotating striking driver (26). When that rotation of the rotating striking driver strikes the struck golf ball, the rotation is transferred to the struck golf ball in the reverse direction, as shown in FIG. 6, whereby the topspin of the rotating striking driver becomes backspin on the struck golf ball.

Figure 8:
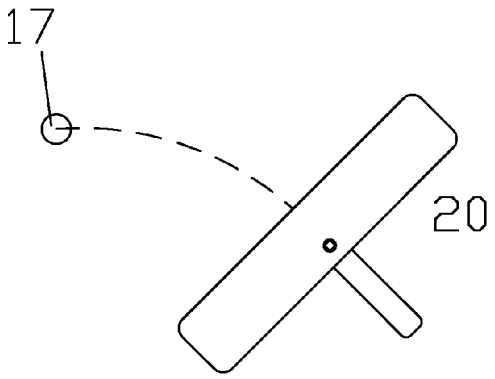
FIG. 8 shows how backspin on a golf bow canted to the left generates both backspin and hook.
Figure 9:
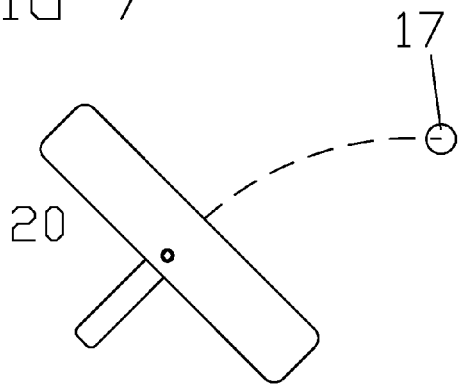
FIG. 9 shows how backspin on a golf bow canted to the right generates both backspin and slice and the effect on the struck golf ball's (17) path.

With both the rotating striking driver and non-rotating striking head implementations of the present disclosure, there is another method to impart hook and slice to the golf ball or similar propelled object. That is by canting the entire golf bow apparatus manually during aiming before firing it. If hook is desired the apparatus can be set for backspin and if it is canted 45 degrees to the left as shown in FIG. 8 the effect will be for the struck ball to have both backspin and hook, thus tending to rise and curve to the left at the same time as shown in FIG. 8. To impart slice, the entire golf bow is canted to the right as in FIG. 9. To one familiar with the state of the art of imparting traditional hook, slice and hook with topspin (duck hook) and slice with topspin can all be accomplished by using just backspin or topspin and canting the golf bow to either side in varying amounts to get the desired result.

The current disclosure is not limited to just one of these methods and devices for imparting various forms of spin to the struck golf ball. One, two or more of these methods can be used for a single shot.

The path of the striking driver (26) or (27) can be directed with multiple methods for those skilled in the state of the art so as to strike the struck golf ball (17) with repeatable accuracy. It can be but is not restricted to being directed simply with the tension of the golf bow cable/string holding (40) it in a repeatable path. It can be guided via an enclosing tube that is split at the center so that one half is above the cable/string and the other half below it. This guides the striking driver, and the preferred embodiment is to control the path of the striking driver via rails or similar apparatus as illustrated in FIG. 2.5, FIG. 3 and FIG. 4. In FIG. 2.5 which is in front view, (110) is in the users perspective when firing the upper left guide rail and the lower left guide rail is (111), the upper right guide rail is (112) and the lower right guide rail is (113). In FIG. 3, (110) is the upper left guide rail and (112) is the upper right guide rail, the lower right guide rails can not be seen in this view. FIG. 2.5 best shows how the guide rails fit into the left driver guide (37) and the right driver guide (38).

In FIG. 2.1 the left driver guide is shown as (37) and the right driver guide is (38). On the rotating striking driver version or the non-rotating version the driver rail guides do not rotate and can be rectangular. The purpose of the driver guides is to align the pathway of the striking driver by following the guide rails so as to hit the struck golf ball in a consistent location each time. The guiding rails can be adjusted so as to squarely strike the driven golf ball in the center and readjusted by the user, if needed, in the future.

There can be some benefits to consistently hitting the struck golf ball (17) off center either left, right, high or low for additional ball control and this disclosure does make that available to the end user. The driver rail guides 37 and 38 in FIG. 2.1 are female guides and the rails are male as best shown in FIG. 2.5, but just as easily that can be reversed. The driver rail 37 and 38 guides wrap around on both sides of the guide rail 110-112 in the preferred embodiment, but they can also just be on just one side of the rail similar to how rail car wheels just wrap around one side of the rail.

B. Method of Operation

For a user to operate the current disclosure, the steps involved would be first insert the golf ball into the ball loading port (9) in FIG. 1, then to retract the striking driver (26) or (27) to the desired power level by rotating the jack-screw FIG. 2 (11) via the socket FIG. 1 (13) at rear of the jack-screw with an electric motor such as in an electric drill, or alternatively with a wrench, ratchet or similar device, or manually via a rope or cord (12) rotate the jack-screw via the cord pulley (18).

The next step is to aim the entire golf bow apparatus in the desired direction and at the desired angle. Alternatively the various methods and devices to impart spin to the ball such as backspin, topspin, hook and slice can be employed as previously described in the Functional Operation section of the current disclosure before aiming and firing the golf bow. One aspect of aiming can be the canting of the golf bow to the left or right to convert part of the back spin or top spin into hook and slice, if the user so desires.

The next step in the Method of Operation is that when the user is ready to make the shot in a safe manner, the user must overcome the various safety devices and methods previously described in this disclosure that may or may not be part of golf bow, such as the manual safety, the grip safety (24) in FIG. 2, the forearm safety (25), the trigger shield safety 42, and the object sensor safety 55. The invention can use all, some, or none of these safeties.

At this point, the user pulls the trigger (23) in FIG. 2 and the golf bow fires the striking driver of type (26) or (27) towards the struck golf ball (17) which exits the golf bow.

The struck golf ball (17) may have various forms of spin on it when it leaves the golf bow as previously described in the current disclosure.

ALTERNATIVE EMBODIMENTS

The present description is applicable to a wide variety of applications and is not limited to any particular type of non-metallic object that is propelled. A tennis ball, baseball, and many other objects can be propelled in such a manner.

A preferred embodiment is using a spring for power similar to a crossbow. That bow can be in many configurations such as the one shown which is compact in form factor or the many other possible configurations including but not limited to the traditional crossbow configuration.

Another embodiment for propulsion is to use a spring such as a bow to propel a piston that then compresses a gas such as air behind the driven ball or a piston like device that then propels the driven ball with gas pressure.

Another embodiment is to use other spring types such as coil springs and to use such springs under compression, tension or torque to generate the energy to propel the ball or other object in the current disclosure.

Many aspects of the current disclosure can be used independently such as applying the various ball spin methods and apparatuses to other means to launch golf balls.

It is a feature of the present invention that the apparatus is portable, and is operated by human power. The apparatus does not require an external source of power. Power for propelling the golf ball, or other projectile, is derived from the force exerted manually by the user, in retracting the striking driver. Thus, the device of the present invention can be conveniently used on a golf course or other location where there is no convenient source of power.

Figure 10:
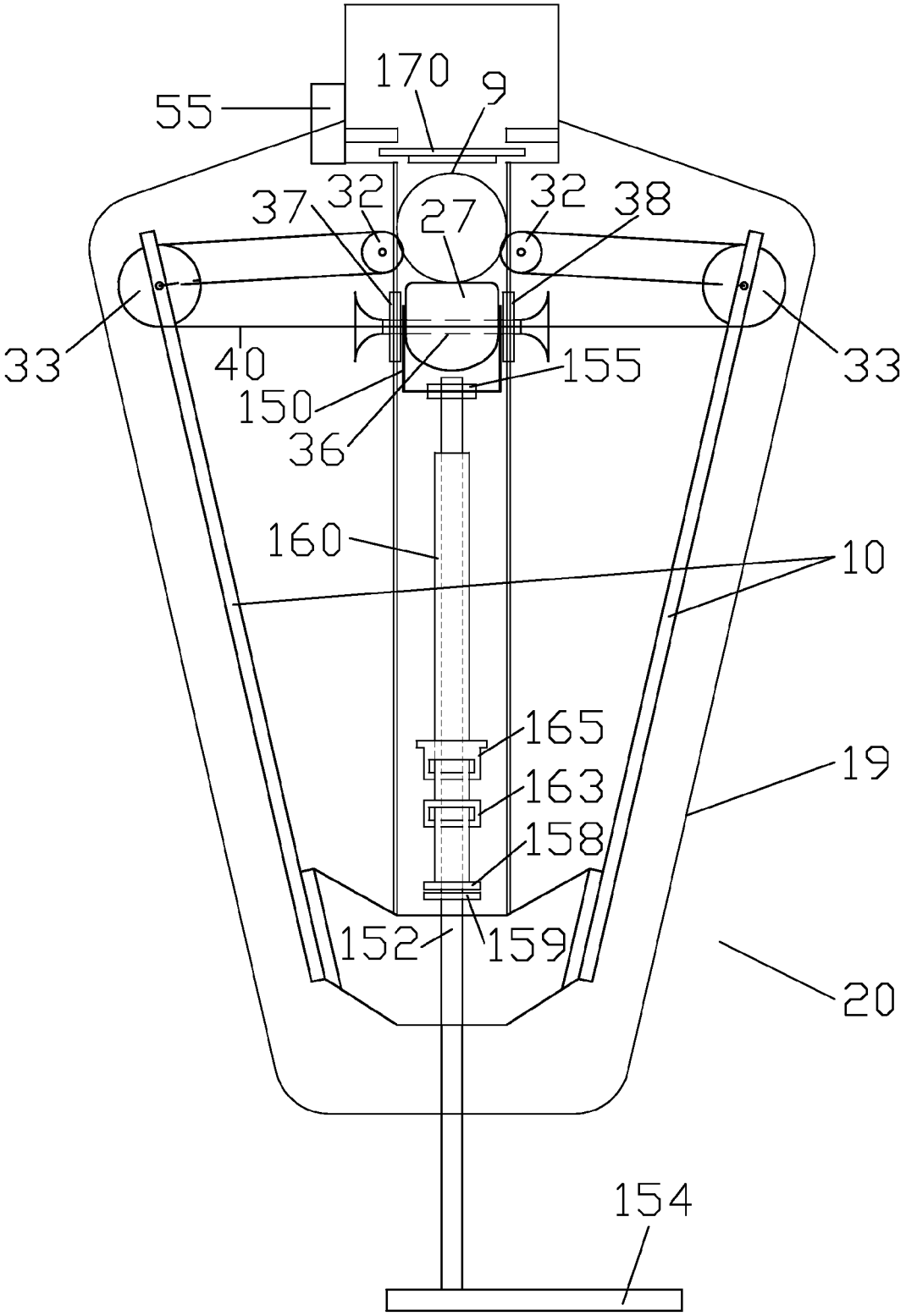
FIG. 10 provides a top view of an alternative preferred embodiment which uses a rotary trigger mechanism.

A more preferred embodiment for retracting the string/cable (40) in FIG. 10, is to have a rotary trigger tube (150) in FIGS. 10 and 14 that is a hollow tube with the rear end capped, which has a larger inside diameter than the outside diameter of the striking driver (27) in FIG. 10, and when pushed forward over the striking driver surrounds it and has two slots that allow the carriage tube (36) in FIGS. 10 and 14 to fit inside. Then, as shown in FIG. 14B, the rotary trigger tube is rotated to lock the striking driver carriage tubes and allow tension to be applied to the bow string/cable to retract the striking driver. A carriage tube bearing can be added to striking ball carriage tube (36) in FIGS. 10 and 14 if lower friction is desired. In this specification, a reference to "FIG. 14" should be deemed to refer to FIGS. 14A and 14B.

The tension to retract the rotary trigger tube can be provided by many methods such as the jack-screw as shown in (11) in FIG. 2. However the preferred embodiment for retracting the trigger tube is to have a rotary trigger rod (152) in FIG. 10 that is attached to the rotary trigger tube (150) in FIG. 10 via nuts (155) in FIG. 10 or welding or other method and that rotary trigger rod is retracted by force on the retraction friction tube thrust washer (158) in FIG. 10 pressing against the rotary trigger rod thrust washer (159) in FIG. 10 which is directly attached to the rotary trigger rod, or direct force on the rotary trigger rod via the trigger handle (154) in FIG. 10 being pulled by hand. The retraction tube thrust washer (158) in FIG. 10 receives its force from a larger hollow tube with the preferred embodiment being a square tube and hereby referred to as the retraction friction tube (160) in FIG. 10. The tube 160 is not limited to being square, as round and hexagonal and other tube shapes could be used instead. The retraction friction tube (160) in FIG. 10 is grabbed by the retraction tube binder (165) in FIG. 10. The retraction tube binder prevents the retraction friction tube from moving forward; it acts as a ratchet to hold the load and prevent forward release of the rotary trigger rod (152) in FIG. 10 in one direction and allows further retraction in the other.

The force to retract the retraction friction tube (160) in FIG. 10 can be provided in multiple ways, but not limited to the following. The preferred embodiment is a retraction lever (180) in FIG. 11 that can be used for mechanical advantage that engages its own binder, the retraction lever binder (163) in FIGS. 10 and 11, to grab the retraction friction tube (160) in FIGS. 10 and 11 and move it back, further retracting the rotary trigger rod (152). The retraction friction tube is then held by the retraction tube binder (165) in FIG. 10, so another stroke of the retraction lever (180) in FIG. 11 is possible. A jack-screw and many other methods in the current state of the art can retract the retraction friction tube (160) in FIG. 10.

The method to fire the golf bow apparatus after it has been retracted to the desired power level is to rotate the rotary trigger handle (154) in FIG. 10, which is attached to the rotary trigger rod (152) in FIG. 10, and that rotates the rotary trigger tube (150) in FIGS. 10 and 14, allowing the striking ball carriage tube (36) in FIGS. 10 and 14 to line up with the exit path and fire the golf bow by releasing the striking ball/head (27) in FIG. 10. Although there is considerable linear pressure on the string/cable (40) in FIG. 10 and the retraction tube binder (165) in FIG. 10 and the thrust washers (158 and 159) in FIG. 10, the effort to rotate the rotary trigger rod (152) in FIG. 10 is minor because the rotary trigger thrust washer and rotary trigger tube are the two parts of the retraction trigger rod that have rotary friction and that rotary friction is minor. The rotary trigger thrust washers in the preferred embodiment have a low friction material to allow the retraction friction tube (158) in FIG. 10 and rotary trigger rod (152) in FIG. 10 to rotate separately from each other easily, even when under pressure. Although a golf ball striker is used for this explanation, this retraction and triggering mechanism can be used on conventional cross bows that fire bolts and other devices. The rotary trigger handle (154) in FIG. 10 is a solid extension of the rotary trigger rod (152) in FIG. 10, and it moves linearly with the rotary trigger rod. The rotary trigger handle can also be stationary linearly and the rotary trigger rod can slide back and forth within it, yet via a keyway or welding a square tube over and to the rotary trigger rod, the rotary trigger handle can still rotate the rotary trigger rod and fire the golf bow by having an internal shape that surrounds and grabs the rotary trigger rod for rotation, while not blocking back and forth motion of the rotary trigger rod. This is not pictured but easy with the current state of the art to accomplish. Note that the rotary trigger rod (152) rotates, but the retraction friction tube (160) does not.

The carriage tube (36) of FIGS. 14A and 14B can be round, square or of another shape, with the preferred embodiment for the rotary trigger tube (150) trigger system being to have a square edge in contact with the rotary trigger tube. A square edge (36) as shown in FIG. 14B will release faster and with less vibration, as it can exit straight forward. A round carriage tube will trigger after the center point is reached, but will bounce back and forth somewhat in the exit path of (150), which will cause the string/cable (40) in FIG. 10 to vibrate.

The current disclosure using the preferred embodiment of a rotary trigger mechanism can employ multiple safety devices, which include a gate safety (170) in FIG. 10 that prevents a golf ball (17) in FIG. 10 from exiting the golf bow until moved out of the way, an additional safety that prevents the gate safety (170) in FIG. 10 from being moved out of the way, and a rotary trigger handle safety lever/button as shown in (151) in FIG. 12 that prevents rotation of the rotary trigger handle (154) in FIG. 10 and FIG. 12 to fire the golf bow unless it is actively depressed so as to retract the rotary trigger rod safety lock (153) in FIG. 12. The preferred embodiment of the gate safety (170) in FIG. 10 is to have an energy absorbing material to dampen a golf ball if it is fired against the gate safety. The object sensor safety (55) in FIG. 1 that detects if an object is inline with the firing path of the golf bow, at a certain distance, can work with any of the embodiments of the present disclosure.

To reduce power or eliminate the power of a drawn golf bow using the rotary trigger method, the user can remove the pressure on the retraction tube binder (165) in FIG. 10 by slightly retracting the bow further with the retraction lever (180) in FIG. 11 after disabling the spring tension on the retraction tube binder, (165) in FIGS. 10 and 11, so that about 75% of the normal retraction travel is skipped before grabbing the retraction tube binder. Then push the retraction tube binder retraction release lever (167) in FIG. 11, then allow the retraction friction tube (160) in FIG. 10 to move in the direction of less stored power, and then release the retraction tube binder (165) in FIG. 10 with the retraction tube binder retraction release lever (167) in FIG. 11. This method allows the user to move the retraction friction tube (160) in FIG. 10 and FIG. 11, backwards, for less power, about 75% of the distance of a normal lever movement to increase power.

Another embodiment of the striking driver is shown in (29) in FIGS. 13A and 13B. In this embodiment, the striking driver comprises one half of a golf ball or similar shaped generally hemispherical object attached to the front of the striking driver carriage. This distributes the impact pressure on firing over a larger area than (26) in FIG. 3. FIG. 13A shows a substantially complete hemisphere, whereas in FIG. 13B the nose is flattened, so as to be less sensitive to a slightly off-center striking of the driven golf ball. The back side of (29) in FIGS. 13A and 13B can be of many possible shapes and materials, for aerodynamic and center of gravity purposes.

The invention can be modified in other ways, as will be understood by the reader skilled in the art. Such modifications should be considered within the spirit and scope of the following claims.

What is claimed is:

1. An apparatus for propelling a projectile, comprising:

a carriage which holds a striking driver, the carriage being mounted for guided movement along a predetermined path;

a cable or string which engages the carriage;

means for retracting the carriage from an equilibrium position to non-equilibrium position, wherein the cable or string is configured such that retraction of the carriage increases tension in the cable or string;

means for releasing the carriage and the striking driver, wherein tension in the cable or string causes the carriage to move;

means for guiding the carriage such that the striking driver impacts the projectile held in a loading port on the apparatus; and means for an active safety device release mechanism for selectively preventing the apparatus from propelling the projectile;

the striking driver for directly impacting the projectile is rotatably mounted on the carriage; and the striking driver can spin complete revolutions about its rotational axis during its travel from its non-equilibrium position to its equilibrium position.

2. The apparatus of claim 1, further comprising:

means for applying differential friction to the projectile at the loading port and only at the point of impact from the striking driver on the projectile; and wherein the loading port disposed toward an end of the frame furthest from a non-equilibrium position of the striking driver.

3. The apparatus of claim 2, wherein:

the differential friction provides a spin in a first direction or a second direction; and the first direction is different from the second direction.

4. The apparatus of claim 2, wherein:

the means for applying differential friction to the projectile is configured to apply to the projectile at least one of:

a first spin comprising one of a topspin and a backspin; and a second spin comprising one of a left spin, and a right spin; and a combination of the first spin and the second spin to the projectile.

5. The apparatus of claim 1, wherein:

the striking driver has a mass that is approximately equivalent to or less than a mass of the projectile and that is greater than half the mass of the projectile.

6. The apparatus of claim 1, wherein:

the apparatus is hand-held.

7. The apparatus of claim 1, further comprising:

at least one stationary pulley and at least one moveable pulley coupled to the frame.

8. The apparatus of claim 1, further comprising:

a plurality of different types of mechanical advantage devices to create a compound reduction in a force needed to generate stored energy; and wherein:

at least one of the plurality of mechanical advantage devices is a lever.

9. The apparatus of claim 1, further comprising:

a safety mechanism coupled to the striking driver to prevent an accidental release of the striking driver.

10. The apparatus of claim 1, further comprising:

a gate safety plate disposed on the frame in front of the path of the projectile to prevent a discharge of the projectile from the apparatus being accidentally fired; and wherein:

the gate safety plate is comprised of an energy-absorbing material that prevents the golf ball from exiting the apparatus until the gate safety is moved out of the way.

11. The apparatus of claim 1, further comprising:

a safety mechanism disposed on the frame that requires at least one hand of a user to be properly placed in a specified location on the apparatus to release the safety mechanism and enable the propelling of the projectile.

12. The apparatus of claim 1, further comprising:

a port for receiving a golf ball; and wherein:

the striking driver is disposed apart from the projectile when the striking driver is in a non-equilibrium position; and the port is disposed approximately at an equilibrium position with the striking driver touching the projectile.

13. The apparatus of claim 1, wherein:

the projectile is a golf ball.

14. The apparatus of claim 1, wherein:

the striking driver is not connected to, and is not contacting against, the projectile held in the loading port when the striking driver is in a non-equilibrium position; and the cable or string is not connected to, and is not in contact with, the projectile.

15. The apparatus of claim 1, further comprising wherein:

means for ratchetly retracting the striking driver via multiple strokes of a mechanical advantage from the equilibrium position to a variable non-equilibrium position to provide a variable draw of the striking driver.

16. The apparatus of claim 1 further comprising:

a rotary trigger tube that is rotatably coupled to the striking driver; and wherein:

a rotary trigger assembly is displaced with the striking driver.

17. The apparatus of claim 1, wherein:

the striking driver is one of a golf-ball size and mass, or approximately a half-golf ball size and mass.

* * * * *